United States Patent [19]

Mergler

[11] Patent Number: 4,739,822

[45] Date of Patent: Apr. 26, 1988

[54] LOW PROFILE ELEMENT BASKET ASSEMBLY FOR HEAT EXCHANGER

[75] Inventor: Thomas G. Mergler, Bolivar, N.Y.

[73] Assignee: Combustion Engineering, Inc., Windsor, Conn.

[21] Appl. No.: 84,063

[22] Filed: Aug. 11, 1987

[51] Int. Cl.[4] ..... F28D 19/04

[52] U.S. Cl. ..... 165/10; 165/8

[58] Field of Search ..... 165/8, 10

[56] References Cited

U.S. PATENT DOCUMENTS

| | | | |
|---|---|---|---|
| 3,465,815 | 9/1969 | Wheeler | 165/10 |
| 3,874,442 | 4/1975 | Johnsson | 165/10 |
| 3,996,997 | 12/1976 | Regan et al. | 165/10 |
| 4,209,060 | 6/1980 | Viking et al. | 165/10 |
| 4,345,640 | 8/1982 | Cullinan | 165/10 |
| 4,561,492 | 12/1985 | Bellows | 165/10 |

*Primary Examiner*—Albert W. Davis, Jr.
*Attorney, Agent, or Firm*—William W. Habelt

[57] ABSTRACT

An element basket assembly (30) for a rotary regenerative heat exchanger (2) comprised of a plurality of heat transfer element plates (32) stacked in an array between first and second end plates (34,36) disposed at opposite ends of the stacked array of heat transfer element plates (32). Upper and lower side straps (40,42 and 50,52) run along opposite sides of the stacked array of heat transfer element plates, to interconnect the first and second plates (34,36) to form the frame of the element basket housing the heat transfer element plates. A stiffening member (60) is disposed intermediate the spaced end plates (34,36) to extend transversely across the element basket assembly at or near the mid-span thereof the interconnect the upper side straps (40,42) and to interconnect the lower side straps (50,52) thereby increasing the structural integrity of the basket assembly.

5 Claims, 2 Drawing Sheets

LOW PROFILE ELEMENT BASKET ASSEMBLY FOR HEAT EXCHANGER

BACKGROUND OF THE INVENTION

The present invention relates to heat transfer element baskets and, more specifically, to an assembly of heat absorbent plates in a basket for use in a heat exchanger wherein heat is transferred by means of the plates from a hot heat exchange fluid to a cold heat exchange fluid. The present invention has particular application in heat transfer apparatus of the rotary regenerative type wherein the heat transfer element is heated by contact with a hot gaseous heat exchange fluid and thereafter brought in contact with a cool gaseous heat exchange fluid to which the heat transfer element gives up its heat.

One type of heat exchange apparatus commonly used for gas-to-gas heat exchange in the process industry and for gas-to-air heat exchange on utility steam generators is the well-known rotary regenerative heat exchanger. Typically, a rotary regenerative heat exchanger has a cylindrical rotor divided into compartments in which are disposed a mass of heat transfer element which, as the rotor turns, is alternately exposed to a stream of heating gas and then upon rotation of the rotor to a stream of cooler air or other gaseous fluid to be heated. The heat absorbent mass typically comprises a plurality of heat transfer element basket assemblies mounted in sector shaped compartments. Each of the heat transfer element basket assemblies houses a plurality of heat transfer plates which when exposed to the heating gas absorb heat therefrom and then when exposed to the cool air or other gaseou fluid to be heated, the heat absorbed from the heating gas by the heat transfer plates is transferred to the cooler gas.

Typically, such an element basket assembly comprises a pair of spaced end plates held together by paired side straps interconnecting the end plates along the sides thereof such as shown in U.S. Pat. Nos. 3,314,472 and 4,606,400. A plurality of heat transfer plates are stacked in closely spaced relationship within the basket housing to provide a plurality of passageways between adjacent plates through which the heat exchange fluids pass. The side straps which interconnect the spaced end plates extend in pairs along the opposite sides of the stacked array of heat exchange elements. On each side of the heat exchange element is a first side strap extending between the upper regions of the spaced end plates and a second side strap extending between the lower region of the end plates in spaced, parallel relationship to the first side strap. The side straps may be flanged inwardly along the longitudinal edge lying at the edge of the basket assembly to provide a retaining surface for preventing the heat transfer plates from falling out of the open ends of the element basket as shown in U.S. Pat. No. 3,314,472. Typically, one or more retaining bars are welded between the end plates across the top and bottom ends thereof to further assist in keeping the heat transfer element plates from falling out of the open ends of the element basket.

Although such basket assemblies are commonly used, low profile basket assemblies may be subject to rotational torsion of the side straps and lateral deformation due to bowing of the side straps interconnecting the spaced end plates.

It is, therefore, an object of the present invention to provide a low profile element basket assembly having improved structural integrity.

SUMMARY OF THE INVENTION

The low profile element basket assembly of the present invention comprises a plurality of heat transfer element plates disposed in a stacked array between spaced end plates disposed at opposite ends of the stacked array of heat transfer element plates and interconnected by spaced upper and lower side straps welded to and extending between the sides of the end plates at the upper and lower edges thereof. In accordance with the present invention, at least one stiffening member is disposed within the stacked array of heat transfer element plates to extend transversely across the element basket assembly to interconnect the upper side straps together and to interconnect the lower side straps together thereby providing a structural cross-link between the respective upper and lower side straps whereby the structural integrity of the frame of the element basket assembly is improved.

DESCRIPTION OF A PREFERRED EMBODIMENT

Figure 1:
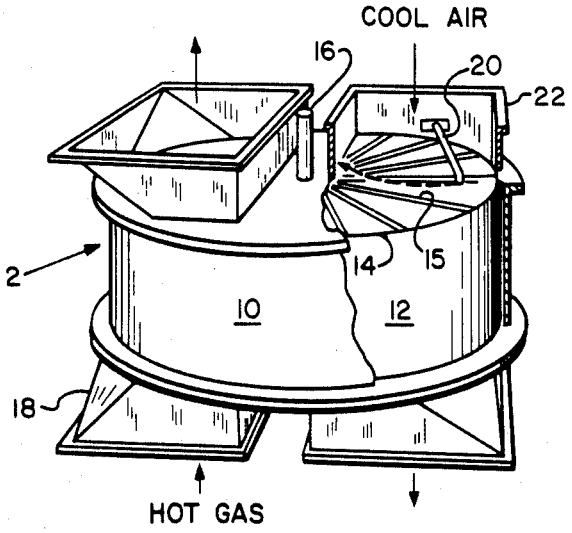
FIG. 1 is a perspective view of a rotary regenerative heat exchanger.
Figure 2:
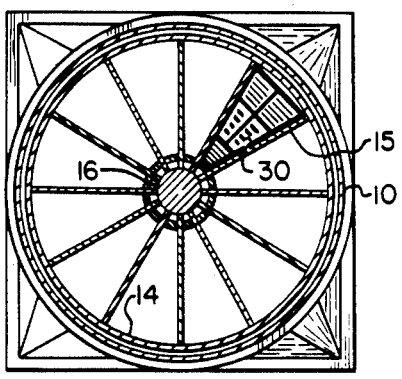
FIG. 2 is a plan view of the rotary regenerative heat exchanger of FIG. 1 taken along line 2—2.

Referring now to the drawings and, more particularly to FIG. 1, there is depicted therein a regenerative heat exchanger apparatus 2 in which the heat transfer element basket assemblies of the present invention may be utilized. The rotary regenerative heat exchanger 2 comprises a housing 10 enclosing a rotor 12 wherein the heat transfer element basket assemblies of the present invention are carried. The rotor 12 comprises a cylindrical shell 14 connected by radially extending diaphragms 15 to the rotor post 16. A heating fluid enters the housing 10 through duct 18 while the fluid to be heated enters the housing 10 from the opposite end thereof through duct 22.

The rotor 12 is turned about its axis by a motor connected to the rotor post 16 through suitable reduction gearing, not illustrated here. As the rotor 12 rotates, the heat transfer element plates carried within the element basket assemblies disposed within the rotor are first moved in contact with the heating fluid entering the housing through duct 18 to absorb heat therefrom and then into contact with the fluid to be heated entering the housing through duct 22. As the heating fluid passes over the heat transfer element plates, the heat transfer element plates absorb heat therefrom. As the fluid to be heated subsequently passes over the heat transfer element plates, the fluid absorbs from the heat transfer element plates the heat which the plates had picked up when in contact with the heating fluid.

Rotary regenerative heat exchangers are often utilized as air preheaters wherein the heat absorbent element serves to transfer heat from the hot flue gases generated in a fossil fuel-fired furnace to ambient air being supplied to the furnace as combustion air as a means of preheating the combustion air and raising overall combustion efficiency. Very often, the flue gas leaving the furnace is laden with particulate generated during the combustion process. This particulate has a tendency to deposit on heat transfer element plates particularly at the cold end of the heat exchanger where condensation of any moisture in the flue gas may occur. In order to provide for periodic cleaning of the heat transfer element disposed within the element basket assemblies, the heat exchanger is provided with a cleaning nozzle 20 disposed in the passage for the fluid to be heated adjacent the cold end of the rotor 12 and opposite the open end of the heat transfer element basket assemblies. The cleaning nozzle 20 directs a high pressure cleaning fluid, typically steam, water, or air, through the plates as they rotate slowly while the nozzle itself sweeps across the end face of the rotor. As the high pressure fluid passes over the heat transfer element plates to vibrate so as to jar loose flyash and other particulate deposits clinging thereto. The loosened particulate is then entrained in the high pressure stream and carried out of the rotor.

The heat exchange material carried in the rotor 12 comprises a mass of metallic heat transfer element plates formed with corrugations or undulations such that when the plates are placed in abutting relationship in a stack array, a series of internal passages are provided through which the heating fluid and cooling fluid flow. The plates are typically assembled in an essentially trapezoidal-shaped frame, termed an element basket, that houses the stacked array of plates with the individual plates held in their stacked order so that they may be handled as an integral assembly for placement within the sector-shaped compartments within the rotor of the heat exchanger.

Figure 3:
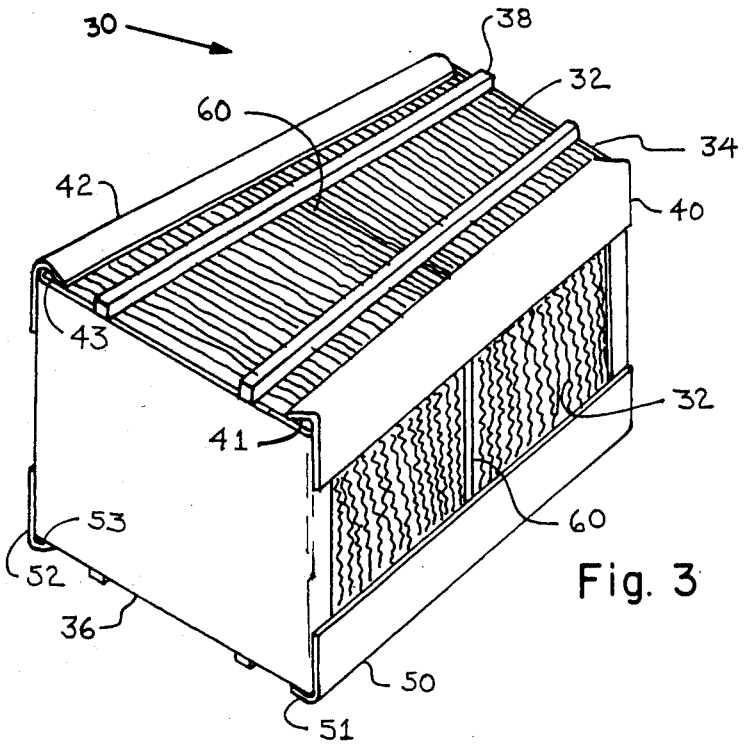
FIG. 3 is a perspective view of an element basket assembly designed in accordance with the present invention.

As illustrated in FIGS. 3 and 4, the element basket assembly 30 of the present invention comprises a plurality of heat transfer element plates 32 juxtaposed in spaced relationship to provide a stacked array of plates having a plurality of flow passages therebetween so as to provide a flow path through which heat exchange fluid may pass in heat exchange relationship with the plates 32. The plates 32 are usually of thin sheet metal capable of being rolled or stamped to a desired configuration, however, the invention is not limited necessarily to the use of metallic plates. The plates 32 may be of various surface configuration such as, but not limited to, a flat surface or a corrugated or undulated surface, or a combination thereof with the flat plates stacked alternately between corrugated or undulated plates. In any case, the stacked array of element plates is disposed between a first end plate 34 at one end thereof and a second end plate 36 at the other end thereof. The end plates 34 and 36 abut the ends of the stacked array of heat transfer element plates and are held in position by means of side straps 40, 42 and 50, 52 which are disposed along opposite sides of the stacked array of heat transfer element plates at the upper and lower edges of the plates, respectively, to interconnect the spaced-apart first and second end plates 34 and 36.

The side plates 40 and 42 are welded at one end to the upper right and upper left corners, respectively, of the end plate 34 and are welded at their other end to the upper right and upper left corners of the opposite end plate 36. Similarly, the side plates 50 and 52 are welded at one end to the lower right and lower left corners, respectively, of the end plate 34 and are welded at their other end to the lower right and lower left corners of the opposite end plate 36.

As best seen in FIGS. 3 and 4, the side straps 40, 42, 50 and 52, are preferably flanged along their longitudinal edges lying at the upper and lower edges of the basket assembly. The flanges 41 and 43 extend inwardly from the inside longitudinal edges of the side straps 40 and 42, respectively, superadjacent the upper edges of the heat transfer element plates 32. Similarly, the flanges 51 and 53 extend inwardly from the inside longitudinal edges of the side straps 50 and 52, respectively, subadjacent the lower edges of the heat transfer element plates 32. The upper flanges 40 and 42 and the lower flanges 50 and 52 provide retaining surfaces along the upper and lower edges of the basket assembly to prevent the heat transfer element plates 32 stacked therein from falling out of the open ends of the basket assembly 30 during transport, handling, or installation. Additionally, retaining bars 38 may be tack-welded between the end plates 34 and 36 at the open top and bottom of the element basket assembly 30 intermediate the side straps in order to further assist in preventing the heat transfer element plates 32 stacked therein from falling out the open ends of the basket element assembly 30.

In accordance with the present invention, a stiffening member 60 is disposed intermediate, preferably midway between, and parallel to the spaced end plates 34 and 36 to extend transversely across the element basket assembly as best seen in FIGS. 3 and 4. The stiffening member 60 is welded at its lateral edges to the side straps 40, 42, 50 and 52 to structurally link the side straps at a point near mid-span thereby increasing the structure integrity of the frame of the element basket assembly 30.

Figure 4A:
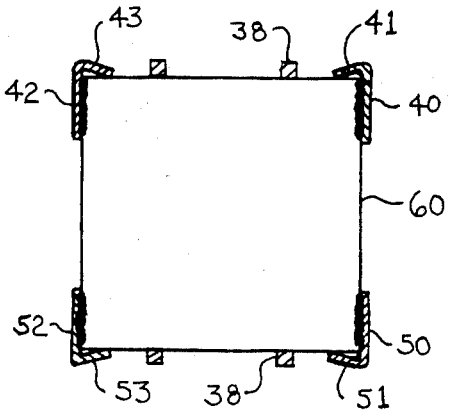
FIGS. 4*a* and 4*b* are cross-sectional elevation views taken along line 4—4 of FIG. 3 showing alternate embodiments of the element basket assembly.

The stiffening member 60 may comprise a single plate similar to end plates 32 and 34 which extends from top to bottom and side to side across the entire cross-sectional area of the element basket assembly 30. The plate 60 is welded at each of its lateral edges to the upper side straps 40 and 42 and the lower side straps 50 and 52 as shown in FIG. 4*a* to structurally link the side straps.

Figure 4B:
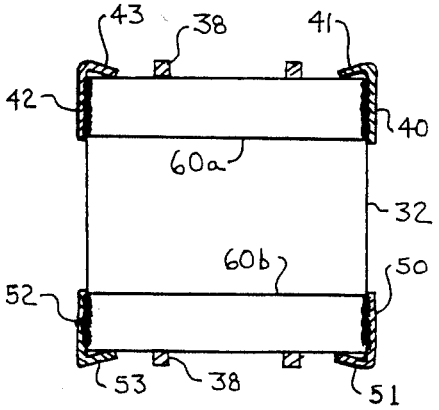

Alternatively, the stiffening member 60 may comprise a pair of spaced elongated plank-like members 6O*a* and 6O*b* which extend, respectively, across the upper region of the element basket assembly and across the lower region of the element basket assembly. As best seen in FIG. 4*b*, the member 60*a* is welded at its lateral edges to the upper side straps 40 and 42, and the member 6O*b* is welded at its lateral edges to the lower side straps 50 and 52.

The stiffening member 60 provides a cross-link interconnecting the upper side straps 40 and 42 and interconnecting the lower side straps 50 and 52 at or near the mid-span between the spaced end plates 32 and 34 of the element basket assembly 30 thereby increasing the structural integrity of the frame of the element basket assembly 30. As a result, not only is the weight capacity of the basket increased, but also rotational torsion of the side straps and lateral deformation of the basket frame are prevented.

Additionally, the lifting of the low profile basket assembly may be simplified by providing lifting holes 70 in the upper region of the stiffening member 60 to provide for the insertion of lifting hooks to lift the basket assembly 30 in the manner disclosed in commonly-assigned U.S. Pat. No. 4,552,204. On low profile basket assemblies not having the stiffening member 60, lifting of the basket assembly must be carried out by grasping the flanges of the side straps at all upper corners of the basket assembly with special hooks designed to slip under the flanges. Hooking holes in the stiffening member 60 would be a far simpler and safer method of lifting a low profile element basket assembly.

It is to be understood that many configurations may be suitable for the stiffening member 60, other than the full plate or spaced plank-like member configurations specifically illustrated and discussed herein, so long as the stiffening member structurally interconnects the upper side straps 40 and 42, and also the lower side straps 50 and 52.

While the heat transfer element basket assembly has been shown embodied in a rotary regenerative heat exchanger of the type wherein the mass of heat absorbent material is rotated alternately between the heating fluid and the fluid to be heated, it would be appreciated by those skilled in the art that the heat transfer element assembly of the present invention can be utilized in a number of other known heat exchange apparatus of either regenerative or recuperative type. Additionally, various stiffening member configurations, some of which have been alluded to herein, may be readily incorporated in the heat transfer basket assembly of the present invention by those skilled in the art. Therefore, it is intended by the appended claims to cover the modifications alluded to herein as well as all other modifications which fall within the true spirit and scope of the present invention as defined by said claims.

I claim:

1. An element basket assembly for a heat exchanger comprising:

a. a plurality of heat transfer element plates juxtaposed in a stacked array;

b. first and second end plates disposed at opposite ends of said stacked array of heat transfer element plates in abutting relationship therewith;

c. a pair of spaced upper side straps disposed along opposite sides of said stacked array of heat transfer element plates interconnecting the upper edges of the sides of the first and second end plates;

d. a pair of spaced lower side straps disposed along opposite sides of said stacked array of heat transfer element plates interconnecting the upper edges of the sides of the first and second end plates; and e. at least one stiffening member disposed within said stacked array of heat transfer element plates intermediate the first and second end plates, said stiffening member extending transversely across the element basket assembly to interconnect said pair of spaced upper side straps and to interconnect said pair of spaced lower side straps.

2. An element basket assembly as recited in claim 1 wherein said at least one stiffening member comprises a single stiffening member disposed within said stacked array of heat transfer element plates at or near mid-span between the first and second end plates.

3. An element basket assembly as recited in claim 1 wherein said side straps each have a flange member extending inwardly from the longitudinal edges of the side straps so as to retaining surfaces extending along the upper and lower edges of the basket element assembly to retain the heat transfer element plates therein.

4. An element basket assembly as recited in claim 1 wherein said stiffening member comprises a plate-like member extending from top to bottom and side to side across the cross-section of the element basket assembly.

5. An element basket assembly as recited in claim 1 wherein said stiffening member comprises spaced upper and lower plank-like members, the upper member extending transversely across the element basket assembly interconnecting said pair of spaced upper side straps and the lower member extending transversely across the element basket assembly interconnecting said pair of spaced lower side straps.

* * * * *